US012546219B2

(12) United States Patent
Youngquist, Jr.

(10) Patent No.: US 12,546,219 B2
(45) Date of Patent: Feb. 10, 2026

(54) AIR DEVELOPED PACKER TESTING SYSTEM

(71) Applicant: Youngquist Brothers, Inc., Fort Myers, FL (US)

(72) Inventor: Harvey Bruce Youngquist, Jr., Fort Myers, FL (US)

(73) Assignee: Youngquist Brothers, Inc., Fort Myers, FL (US)

( * ) Notice: Subject to any disclaimer, the term of this patent is extended or adjusted under 35 U.S.C. 154(b) by 168 days.

(21) Appl. No.: 18/338,187

(22) Filed: Jun. 20, 2023

(65) Prior Publication Data

US 2023/0407745 A1 Dec. 21, 2023

Related U.S. Application Data

(60) Provisional application No. 63/366,655, filed on Jun. 20, 2022.

(51) Int. Cl.

| | |
|---|---|
| ***E21B 49/10*** | (2006.01) |
| ***E21B 33/124*** | (2006.01) |
| ***E21B 47/117*** | (2012.01) |

(52) U.S. Cl.

CPC ..... *E21B 49/10* (2013.01); *E21B 33/1243* (2013.01); *E21B 47/117* (2020.05)

(58) Field of Classification Search

CPC .... E21B 33/1243; E21B 33/12; E21B 47/117; E21B 33/124; E21B 49/10

See application file for complete search history.

(56) References Cited

U.S. PATENT DOCUMENTS

| | | | | |
|---|---|---|---|---|
| 1,547,240 | A * | 7/1925 | Steele | E21B 33/1243 166/185 |
| 5,350,018 | A * | 9/1994 | Sorem | E21B 23/006 73/152.52 |
| 5,465,628 | A * | 11/1995 | Timmons | E21B 33/1243 73/864.34 |
| 2018/0334903 | A1 * | 11/2018 | Lehr | E21B 33/12 |

* cited by examiner

*Primary Examiner* — Yong-Suk (Philip) Ro

(74) *Attorney, Agent, or Firm* — Brandon Cook; Gunn, Lee & Cave, PC

(57) ABSTRACT

A system and method for performing packer testing in subterranean wells using air to remove liquids from an isolated section of the well. Packers are inflated to isolate a section of the well. Air is introduced into the tubing, which creates a vacuum in the tubing. The vacuum pulls liquids out of the isolated zone and up to the surface and out of the well. The vacuum empties the isolated zone so that the zone can be tested.

6 Claims, 4 Drawing Sheets

AIR DEVELOPED PACKER TESTING SYSTEM

CROSS-REFERENCES TO RELATED APPLICATIONS

This application claims the benefit of the filing date of provisional patent application No. 63/366,655.

STATEMENT REGARDING FEDERALLY SPONSORED RESEARCH OR DEVELOPMENT

Not applicable.

BACKGROUND OF THE INVENTION

1. Field of the Invention

The present invention relates to packer testing during the drilling and/or operation of down hole wells.

2. Description of the Related Art

Packer testing is a procedure used in the well drilling industry. Packer testing isolates a specific section of a wellbore, allowing the operator to measure and collect data pertaining exclusively to the isolated section. A standard straddle packer testing system comprises a first inflatable packer and a second inflatable packer. A single packer testing system comprises a single packer. The packer(s) are lowered into the borehole to the desired depth. The packer(s) are then inflated, forming a seal between the packers and the wellbore. The zone between the two packers is isolated from the rest of the wellbore.

In prior art packer testing methods, an electronic submersible pump is lowered into the wellbore, usually to a depth of approximately two-hundred ft. The pump typically has between 1-5 horsepower. The pump is used to pump water, or other liquids, out of the isolated zone.

A series of gauges and pressure transducers measure and record data collected from the isolated section.

In water wells, the isolated zone is often pumped completely dry, so the operator can measure how quickly the isolated section recovers water.

BRIEF SUMMARY OF THE INVENTION

The present invention is an air developed packer system. A vacuum effect caused by the introduction of air is used to remove water and other liquids from the isolation zone, eliminating the need for a submersible pump.

DETAILED DESCRIPTION OF THE INVENTION

Figure 1:
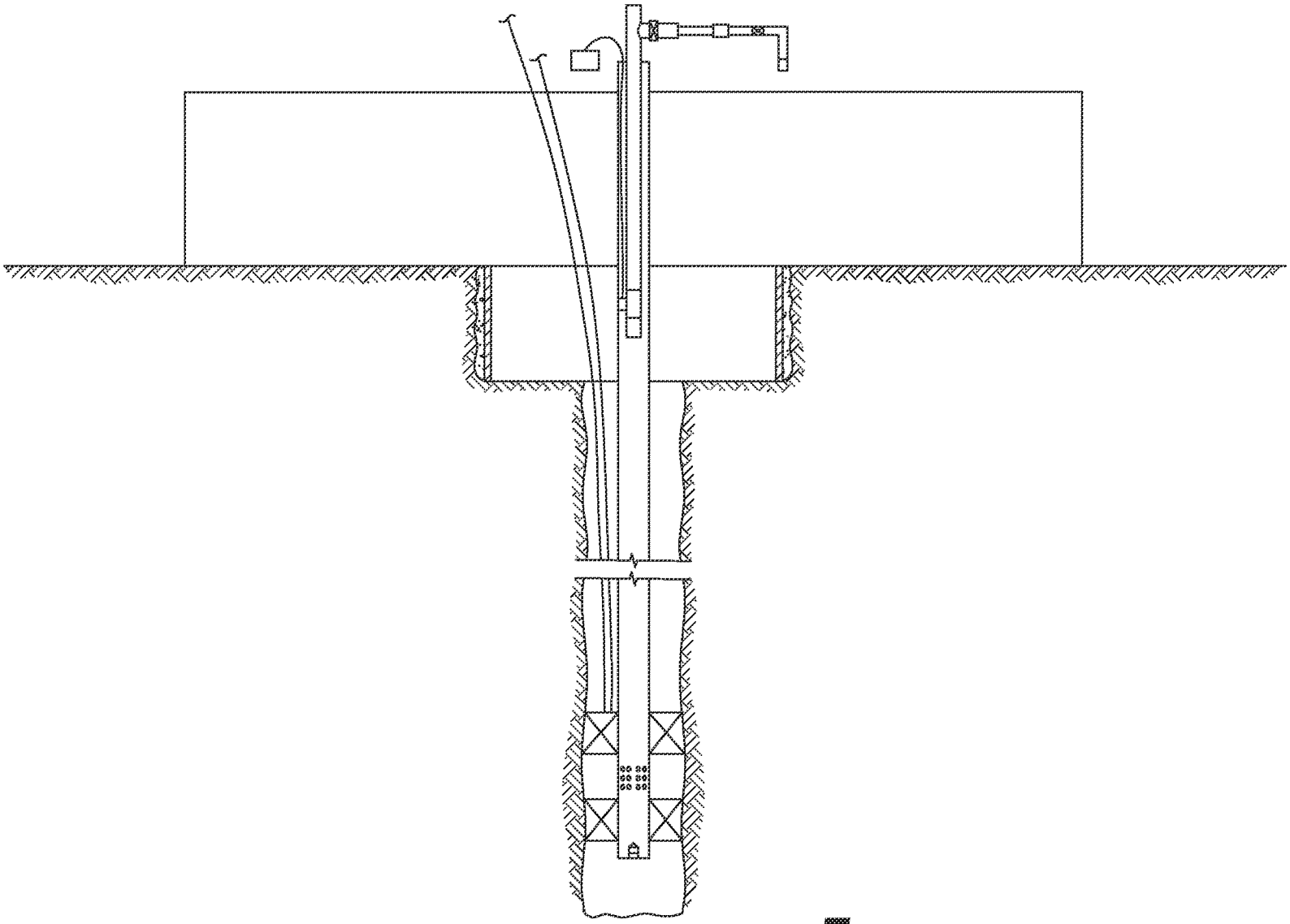
FIG. 1 shows a prior art packer testing system implemented in a water well.
Figure 2:
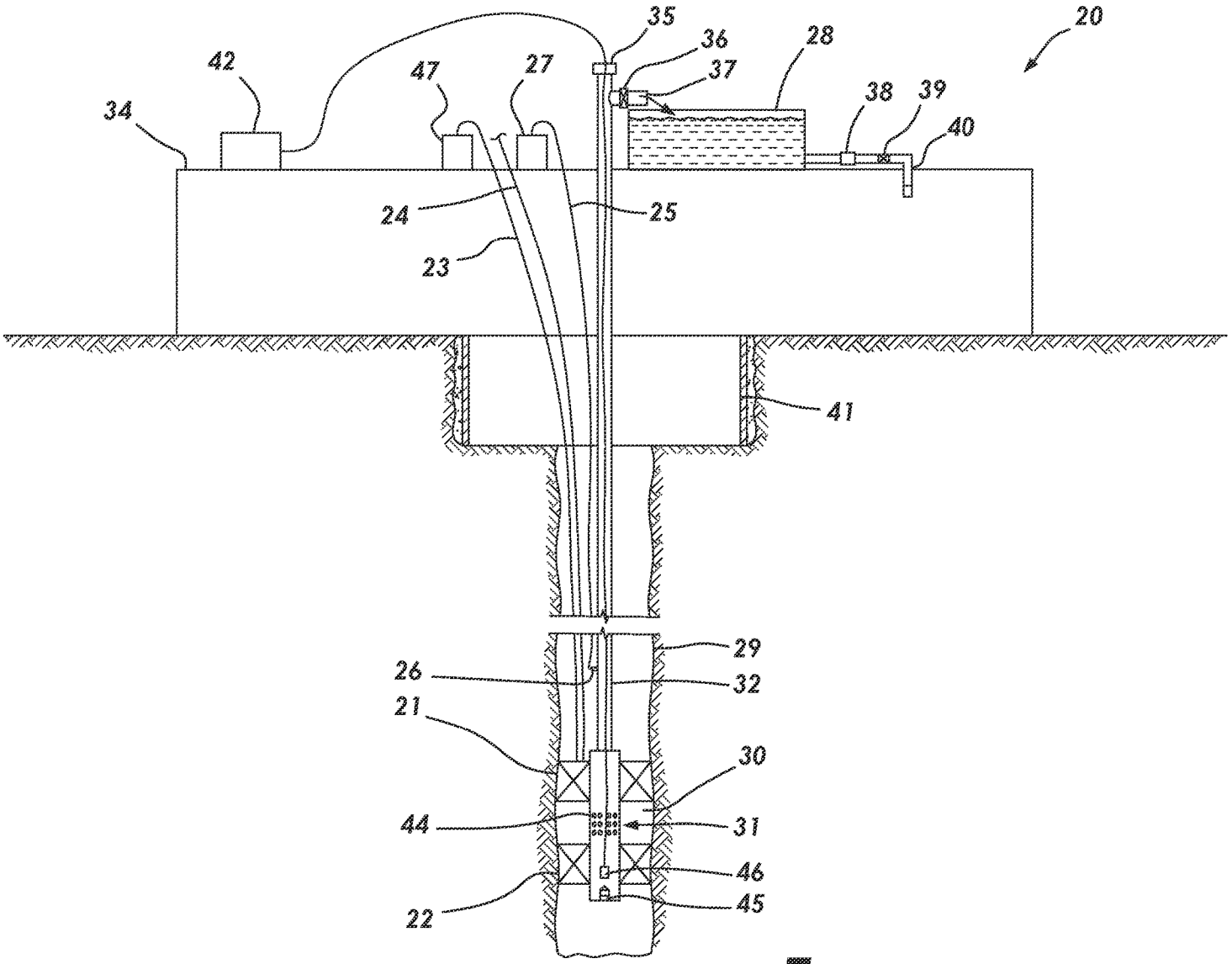
FIG. 2 shows an embodiment of the air developed packer testing system implemented in a water well.

A first embodiment of the air developed packer testing system 20 is described with reference to FIG. 2.

The air developed packer testing system 20 comprises a first packer 21, second packer 22, packer inflate hose 23, packer deflate hose 24, air development hose 25, an air development inlet port 26, an air compressor 27, an equalization tank 28, and a high pressure water pump 47. Additional components of the rig include a rig floor 34, wireline and packoff 35, valve to control discharge 36, development water discharge 37, flow meter 38, discharge valve 39, developmental water disposal/storage 40, casing 41, and surface readout system 42.

The air developed packer testing system is utilized with a traditional drilling rig, such as, but not limited to, a water well or a water disposal well. Standard drilling equipment is used to drill and set a casing 41. A pilot hole 29 is drilled below the casing 41. The term pilot hole is not intended to be limiting. Bore hole, or other nomenclature, could be used to describe the underground hole in which the air developed packer testing system 20 can be implemented.

In the first embodiment described herein, tubing 32 is lowered into the pilot hole to a desired depth. A pipe 31 is located on the downhole end of the tubing 32. The pipe 32 has perforations 44. Memory gauge(s) 45 and pressure transducer(s) 46 are located inside the pipe 32.

Packers 21 and 22 are inserted into the pilot hole 29 and lowered to a desired depth. The packers 21 and 22 are lowered to a depth that corresponds with at least a portion of the pipe 31.

The packers 21 and 22 are inflated using the packer inflate hose 23. In one embodiment, a high pressure water pump 47 is connected to the opposing end of the packer inflate hose 23 and turned on to inflate the packers 21 and 22. The packers 21 and 22 are deflated by opening a valve (not shown) at the surface end of the packer deflate hose which drains water out of the packers 21 and 22.

A jumper hose (not shown) connects the first packer 21 and second packer 22 so that the packers 21 and 22 are in fluid communication with each other and can be inflated and deflated using a single inflate hose and deflate hose. In some embodiments, a second packer inflate hose and second packer deflate hose can be used for the second packer 22.

Once inflated, the packers 21 and 22 create a seal against the interior of the pilot hole 29 and the exterior of a pipe 31. The seal created by the packers creates an isolated zone 30 that is fluidly isolated from water and other fluids in the bore hole above and below the isolated zone 30.

All, or a portion, of the pipe 31 with perforations 44, memory gauges 45, and pressure transducers 46 is located within the isolated zone 30.

Once the isolated zone 30 is sealed, the operator may need to remove water and other fluids from the isolated zone 30. The air developed packer testing system 20 accomplishes removal of water and other fluids from the isolated zone 30 via a vacuum effect created by the introduction of air 33 into the tubing 32.

The tubing 32 comprises an air development inlet port 26. In the embodiment described herein, the air development inlet port is approximately sixty feet above the first packer 21. One end of an air development hose 25 is connected to, and in fluid communication with, the air development inlet port 26. The other end of the air development hose 25 is connected to an air compressor 27 on the rig floor 34.

Air 33 is introduced into the tubing 32 via the air development inlet port 26 by turning on the air compressor 27. The introduction of air 33 creates a vacuum effect, pulling water and other liquids from the isolated zone 30, up the tubing 32, and out of the pilot hole 29 via the development water discharge 37.

One the water and other fluids are removed from the isolated zone 30, the isolated zone 30 can be tested using the memory gauges 45 and pressure transducers 46 in the pipe 31.

A second embodiment 48 of the air developed packer testing system is described with reference to FIGS. 3-5.

The structure and function of the second embodiment 48 is nearly identical to the structure and function of the first embodiment 20. Reference numbers for elements that are common to both the first embodiment 20 and second embodiment 48 are shown in FIG. 5.

In the second embodiment 48, a drill pipe 43 is lowered into the pilot hole 29. The drill pipe 43 more rigid and durable than the tubing 32. In the second embodiment, the tubing 32 is interior of the drill pipe 43.

Figure 4:
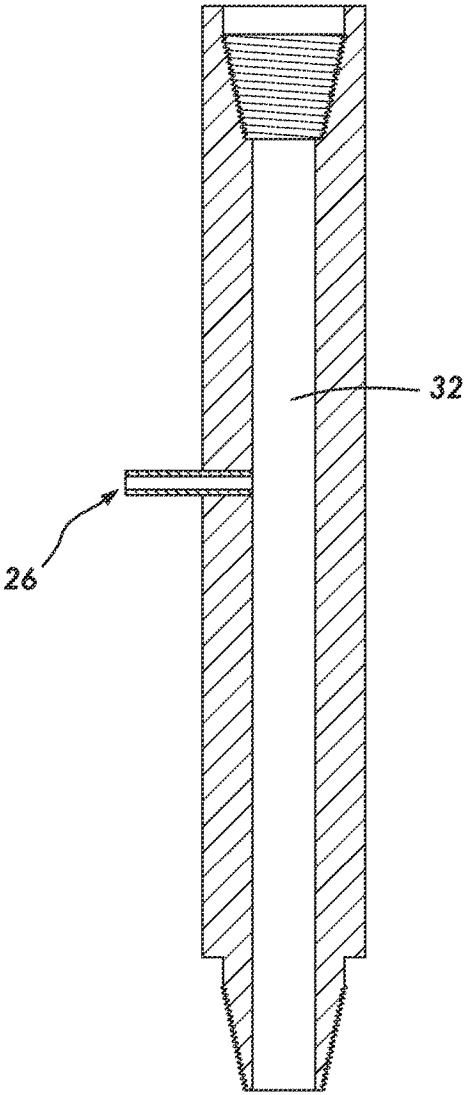
FIG. 4 shows an enlarged view of tubing for an air inlet port of the second embodiment of the air developed packer testing system.
Figure 3:
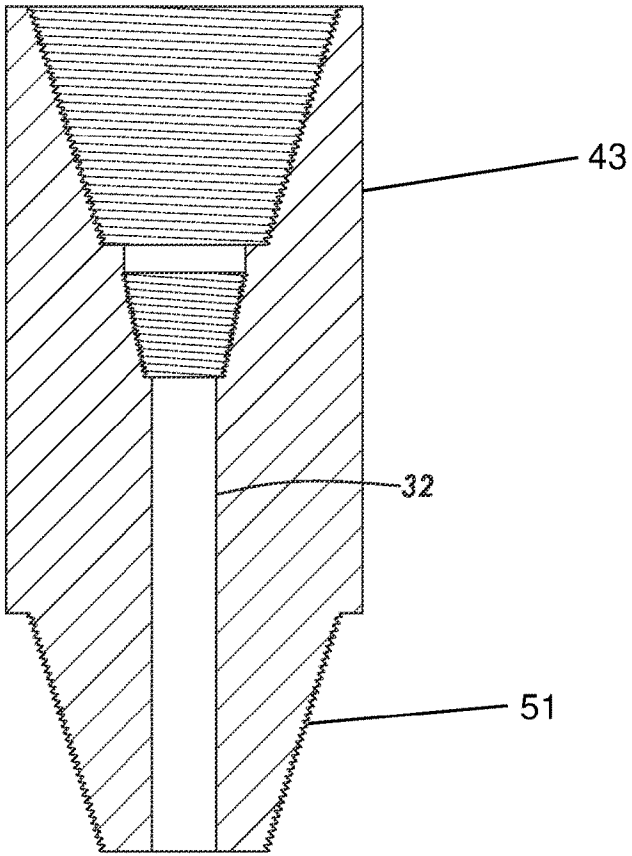
FIG. 3 shows an enlarged view of a cross over sub of a second embodiment of the air developed packer testing system.
Figure 5:
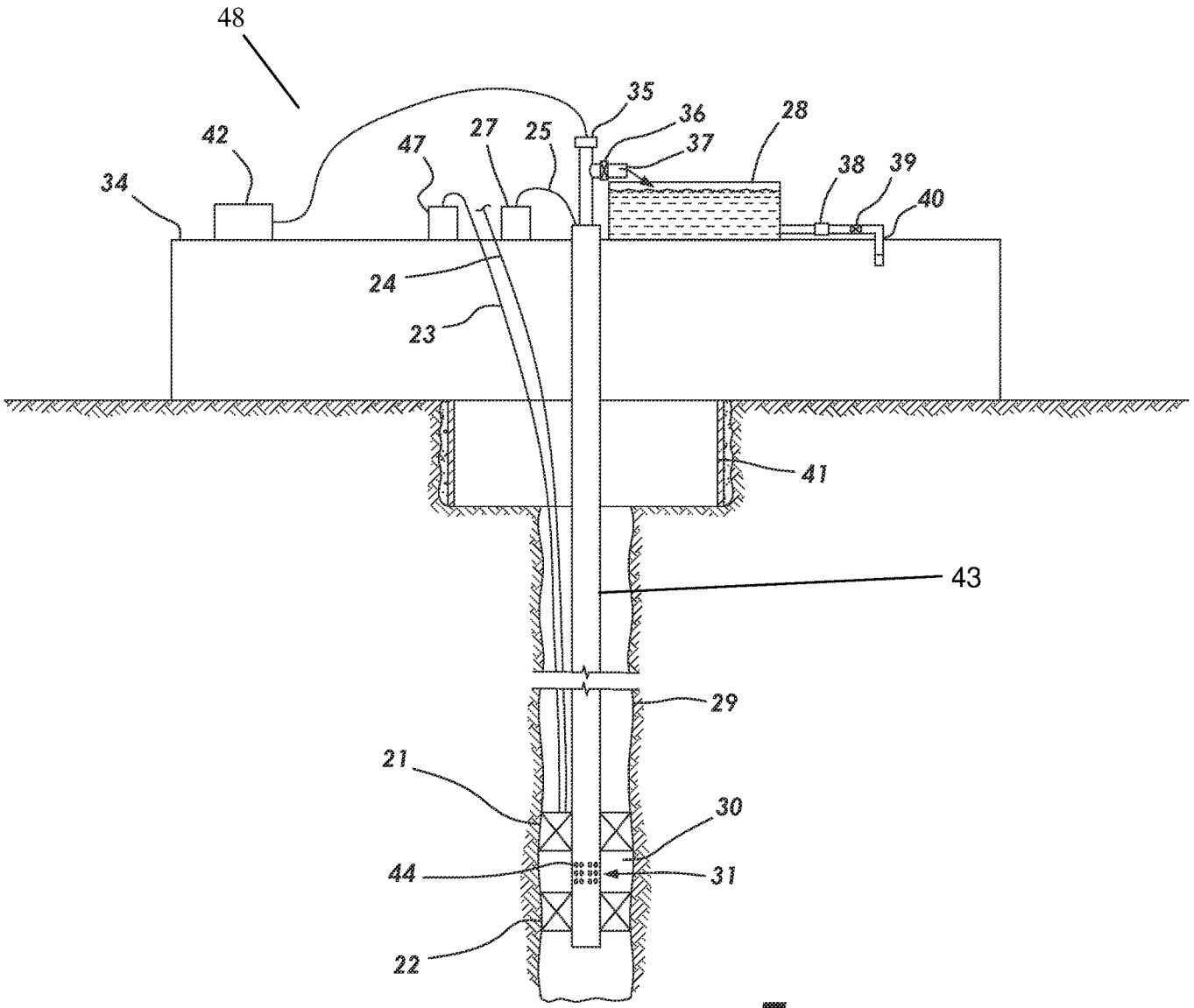
FIG. 5 shows a second embodiment of the air developed packer testing system.

As shown in FIGS. 3 and 4, a cross over sub 49 connects the drill pipe 43 to tubing 32. An air development inlet port 26 is in fluid communication with the tubing 32. A first end of the air development hose 25 is connected to, and in fluid communication with, the air development inlet port 26. A second end of the air development inlet hose 25 is connected to, and in fluid communication with, an air compressor 47 on the rig floor 34.

The drill pipe includes threads 51, which are capable of forming a thread fit with the packers 21 and/or 22. The thread fit between the drill pipe 43 and the packers 21 and/or 22 allows for the drill pipe 43 to be used to pull or push the packers 21 22 up or down the hole 29 if the packers 21 22 get stuck.

The packer testing of the second amendment 48 is the same as the first embodiment. The difference tween the two embodiments is structural, with the inclusion of a drill pipe 43 in the second embodiment.

The air developed packer testing system described herein has several benefits over the existing packer testing systems. The air developed packer testing system can be implemented with much smaller tubing than a submersible pump based packer testing systems. More specifically, the air implemented packer testing system 20 can be implemented with 2' ⅜" tubing 32, whereas submersible pump packer testing requires 6' tubing. Smaller tubing allows Applicant's air developed packer testing system 20 to be quicker and more efficient than existing packer testing systems.

Applicant's air development packer testing also removes fluids from the isolated zone faster than prior art packer testing systems. Prior art packer testing systems in water wells required two to seven days of pumping before the operator could get measurable data. Applicant's air developed packer testing system only requires a few hours of operation to obtain measurable data.

Applicant's air developed packer testing system 20 also enables the user to run a surface readout of the down hole pressure transducers. Prior art versions of packer testing systems requiring a submersible pump utilized memory gauges that stored information which was not available until after the testing was complete and the packers were removed.

Prior art packer requires a week long test before the packers are removed and data is downloaded. If the memory gauges were faulty or an error occurred with the data, tests have to be rerun. The air developed packer testing 20 only requires a couple hours to obtain measurable data. If there is a problem with the data, only a few hours are required to rerun the tests.

The invention claimed is:

1. A method of performing packer testing comprising the following steps:

lowering tubing into a pilot hole, said tubing having a pipe at a lower end of the tubing wherein a portion of said pipe is perforated;

lowering a first and second packer into the pilot hole;

inflating said packers using a packer inflate hose that is in fluid communication with said packers;

upon inflation, said packers forming a seal against the inside wall of the pilot hole and the outer wall of the pipe;

the inflated packers forming an isolated zone between the first and second packer;

the isolated zone being fluidly isolated from a remainder of the pilot hole;

removing materials from the isolated zone by introducing air into the tubing via an air development inlet in fluid communication with the tubing, an air development hose in fluid communication with the air development inlet, and an air compressor in fluid communication with the air development hose.

2. The method of performing packer testing of claim 1 further comprising:

said introduction of air into said tubing creates a vacuum which pulls materials out of the isolated zone and up through the pilot hole.

3. The method of performing packer testing of claim 2 wherein the materials are water and other fluids.

4. The method of performing packer testing of claim 2 further comprising using a downhole pressure transducer to surface read out system to measure pressure in the isolated zone.

5. The method of performing packer testing of claim 4 wherein said measurements are communicated to the surface.

6. The method of performing packer testing of claim 2 further comprising using memory gauges located in the perforated pipe to store data collected from the isolated zone.

* * * * *